US005251116A

United States Patent [19]

Wijbenga et al.

[11] Patent Number: 5,251,116

[45] Date of Patent: Oct. 5, 1993

[54] LUMINAIRE FOR CREATING A PRIMARY BEAM AND A SECONDARY BEAM

[75] Inventors: Hendrik Wijbenga; Jean P. Entrop, both of Eindhoven, Netherlands

[73] Assignee: U.S. Philips Corporation, New York, N.Y.

[21] Appl. No.: 874,255

[22] Filed: Apr. 24, 1992

[30] Foreign Application Priority Data

May 16, 1991 [EP] European Pat. Off. ..... 91107903.6

[51] Int. Cl.[5] ..... F21V 7/00

[52] U.S. Cl. ..... 362/308; 362/293; 362/304; 362/310; 362/328; 362/346

[58] Field of Search ..... 362/307, 293, 304, 308, 362/310, 328, 329, 342, 346

[56] References Cited

U.S. PATENT DOCUMENTS

| | | | |
|---|---|---|---|
| 1,373,845 | 4/1921 | Tillson | 362/307 |
| 1,574,888 | 3/1926 | Hixson | 362/342 |
| 2,085,627 | 6/1937 | Bodnar | 362/307 |
| 2,916,611 | 12/1959 | Odle | 362/307 |
| 3,832,539 | 8/1974 | Oram | 362/293 |
| 4,559,589 | 12/1985 | Sassmannshausen | 362/307 |
| 4,701,832 | 10/1987 | Lasker | 362/307 |
| 5,081,569 | 1/1992 | Quiogue et al. | 362/308 |

*Primary Examiner*—Ira S. Lazarus
*Assistant Examiner*—Alan B. Cariaso
*Attorney, Agent, or Firm*—Paul R. Miller

[57] ABSTRACT

The luminaire for providing a primary (10) and a secondary light beam (14) comprises reflector means (9) and a lamp holder (7) within a housing (1) having a window (2) through which the primary beam passes. Remote from the window (2), the reflector means are provided with an opening (11) for a secondary beam (14). A side wall (3) of the housing (1) has a window through which the secondary beam (14) is reflected to the outside by a reflector (15). The window (13) is provided with a refractor (12) to spread the secondary beam (14). The luminaire has a color filter (11) in the path of the secondary beam and provides an even appearance of a panel illuminated by that beam.

10 Claims, 2 Drawing Sheets

LUMINAIRE FOR CREATING A PRIMARY BEAM AND A SECONDARY BEAM

The invention relates to a luminaire for creating a primary beam and a secondary beam, comprising:

a housing having an emission window for a primary beam and side walls transverse thereto;

a lampholder in the housing for accommodating an electric lamp alongside the emission window;

concave reflector means for throwing light generated by an accommodated lamp through the emission window to the exterior in a primary beam, which reflector means have an opening remote from the emission window;

light-distributing means near a window for a secondary beam in a side wall of the housing; and a reflector in the housing for reflecting light passing through the opening in the reflector means towards the window in a side wall.

BACKGROUND OF THE INVENTION

Such a luminaire is known from British Patent Application GB-1 408 955.

The known luminaire is particularly suitable for use with low-pressure mercury fluorescent lamps. The luminaire in a horizontal arrangement radiates both a primary beam in downward direction and a secondary beam in lateral direction.

The secondary beam may illuminate an external or internal wall of a building or a panel. It is possible for such a panel, for example, to receive so much light in a region lying closest to the luminaire that its appearance considerably deviates from that of regions lying further away. More particularly, the region gives the impression of being lighter in colour and may have a shiny center. This is a disadvantage, since the panel is rendered unattractive by this and the attention is drawn away from the panel as an entity.

SUMMARY OF THE INVENTION

The invention has for its object to provide a luminaire of the kind described in the opening paragraph which facilitates inter alia a more uniform appearance of an item illuminated by the secondary beam.

According to the invention, this object is achieved in that the luminaire comprises a colour filter for the light of the secondary beam.

It is counteracted by means of the colour filter that so much light, for example white light, is radiated from the lamp accommodated in the luminaire onto a location of the irradiated object situated centrally in the beam that the reflection spectrum of the object in this central location is different from the spectrum elsewhere, owing to the fact that the object is no longer capable of sufficiently absorbing colours which are complementary to its own colour. This is prevented by the use of a colour filter which has a transmission spectrum corresponding to the colour of the object, i.e. its reflection spectrum. It is noted in this connection that the use of a colour filter need not adversely affect the illumination effect of the secondary beam of the luminaire because the light to be absorbed by the filter would not contribute to a useful illumination of the object: i.e. to showing the object in the same way as it would look under daylight.

Since a light source has a greater brightness in proportion, the danger of local over-illumination of an object is greater. Nevertheless, a light source of high brightness is favourable since such a light source often converts a high power into light in a small volume, with a high luminous efficacy. Owing to its small volume and its high luminous flux, a high-pressure discharge lamp, for example a high-pressure mercury lamp with metal halide additives, or particularly a high-pressure sodium lamp emitting golden-yellow or white light, is particularly suitable for forming together with reflector means a primary beam which irradiates a wide surface area, for example a floor surface or a road surface. Especially in those cases there is a major risk of the secondary beam locally over-illuminating an object. Such high-pressure discharge lamps often have Edison lamp caps, for example E-40 lamp caps. The luminaire then has an Edison lampholder, for example, an E-40.

In a favourable embodiment, the luminaire has the colour filter in a location where the area of the secondary beam is small, for example, in the opening in the reflector means. A comparatively small filter can then suffice. In addition, the secondary beam may be optimally defined in this way.

Preferably, a profiled glass plate is used in the window, for example, with prismatic or concave semi-cylindrical ridges at the entrance side thereof, for example transverse to the emission window, with the object of spreading the secondary beam substantially parallel to the emission window. For a high and narrow object, the ridges may extend parallel to the emission window. If it is desirable to irradiate a wider area of the object by means of the secondary beam, for example, an area whose extent corresponds to the extent of the ground surface irradiated by the primary beam, the window in the side wall may extend to the adjoining side walls.

The uniformity of the illumination of an object by the secondary beam, in a direction parallel to the emission window, may be improved by kinking the reflector backwards. Thereby, the reflector may e.g. have a kink in a plane through the lampholder.

In a favourable embodiment, the luminaire radiates a secondary beam in two opposite directions away from one another since opposite a window a second window is present in a second side wall.

It is favourable to give the reflector a bent shape. Bends parallel to the emission window spread the secondary beam in a direction transverse to the emission window, so that an object of a given height can be evenly illuminated. The reflector may be so designed that substantially all light from the secondary beam is reflected by the reflector.

In a special embodiment, the emission window is closed off by a glass plate and the luminaire comprises louvres for restricting the emission of light of the primary beam at small angles to the glass plate. It can also be prevented in this way that light of the primary beam and light of the secondary beam become mixed.

It is favourable for the reflector means to have the greatest spreading effect in a plane transverse to a plane in which the reflector has its greatest spreading effect.

BRIEF DESCRIPTION OF THE DRAWING FIGURES

Embodiments of the luminaire according to the invention are shown in the drawings, in which FIG. 1; and is a cross-section perpendicular to the emission window;

DESCRIPTION OF THE INVENTION

Figure 1:
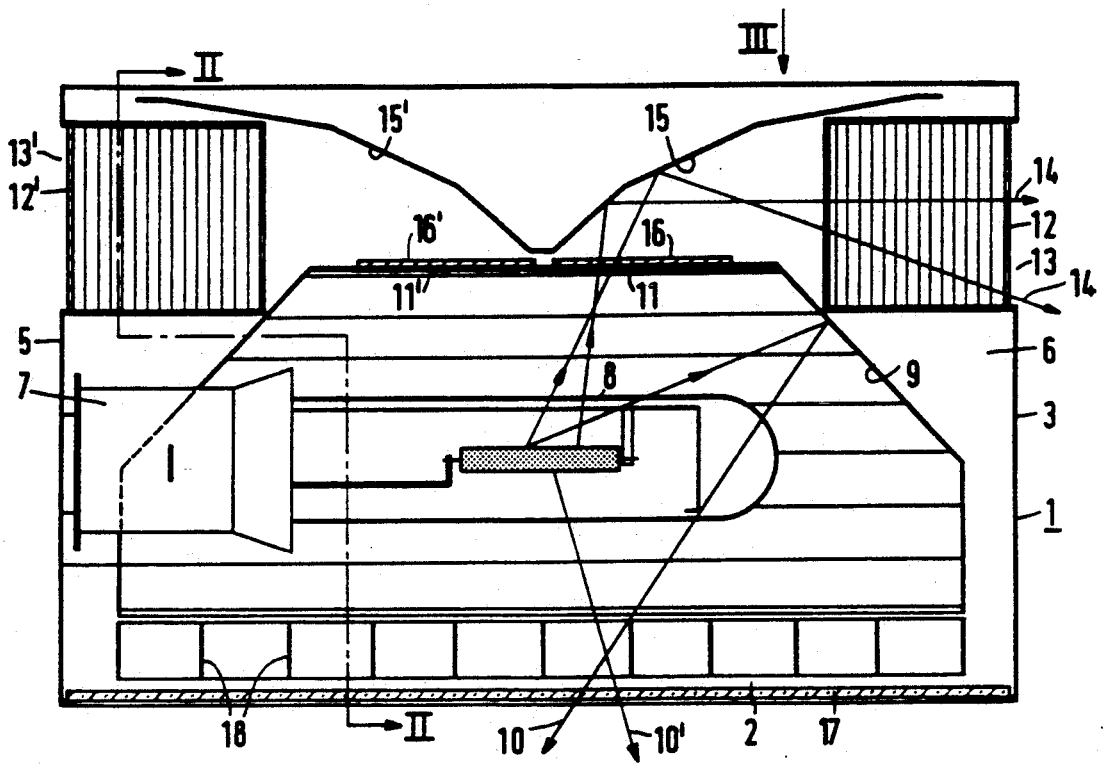
Figure 2:
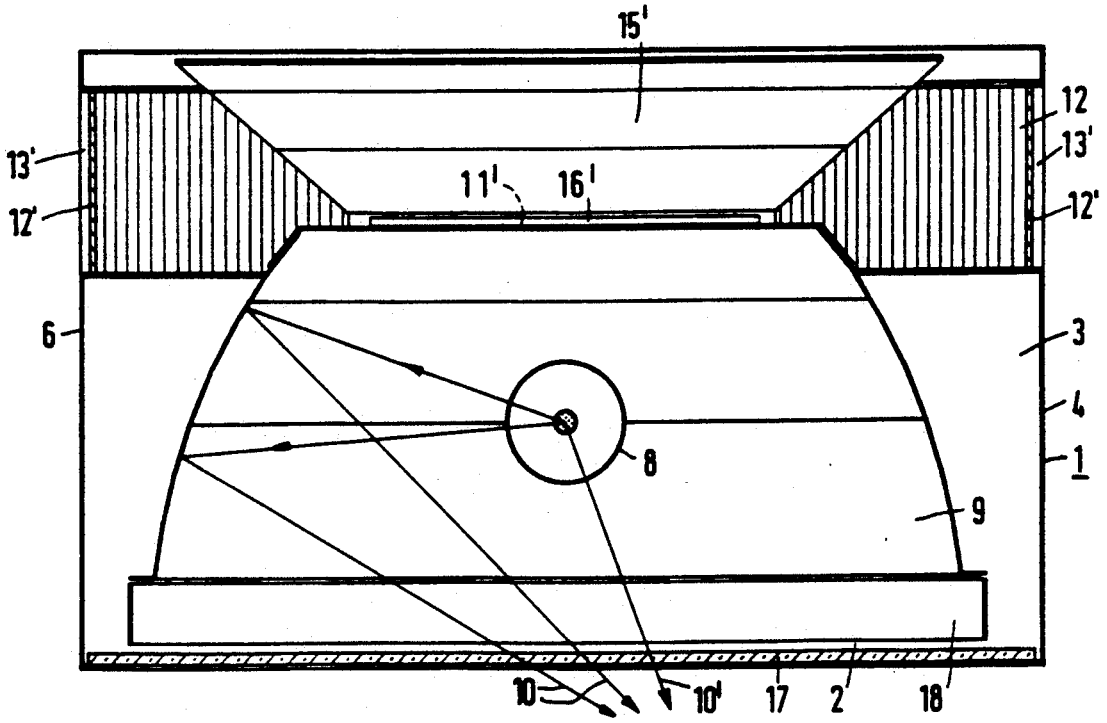
FIG. 2 is a cross-section taken on the line II—II in FIG. 1.

In the Figures, the luminaire for creating a primary beam and a secondary beam comprises a housing 1 with an emission window 2 for a primary beam and side walls 3–6 transverse thereto. A lampholder 7, such as an E-40 lampholder in FIG. 1, is present in the housing for accommodating an electric lamp 8 alongside the emission window. The lamp drawn is a high-pressure sodium lamp which has a power rating of 250 W at a supply source of at least 200 V, radiating golden-yellow light. The lamp has a tubular, transparent lamp vessel in order to allow the generated light to emanate without being obstructed.

Reflector means 9 reflects light 10 of the primary beam generated by the lamp 8 through the emission window 2 to the exterior. In addition, non-reflected light 10' also issues to the exterior. The reflector member 9 has an opening 11 remote from the emission window 2.

Light-distributing means, such as a profiled glass plate 12, for refracting light are present at a window 13 for a secondary beam 14 in a side wall 3. A reflector 15 is positioned in the housing for reflecting light 14, which passes the reflector member 9 through an opening 11, towards the window 13 in the side wall so as to form a secondary beam.

The luminaire has a colour filter 16 for the light of the secondary beam 14. The filter 16 is situated in the opening 11 in the reflector means 9.

A profiled glass plate 12 is present in the window 13, which plate spreads the light 14 of the second beam substantially parallel to the emission window 2. The window 13 extends between the opposing side walls 4, 6.

Opposite the window 13, there is a similar window 13' in a second side wall 5 with a profiled glass plate 12'. A reflector 15' reflects the filtered light of the secondary beam through the glass plate 12' and window 13' to the exterior, so that the luminaire shown radiates secondary beams in opposite directions. In the luminaire drawn, a second opening 11' and a second colour filter 16' are present for the window 13'. The reflector 15 and the reflector 15' are bent substantially parallel to the emission window 2 in order to spread the secondary beam in the plane of the drawing.

The emission window 2 is closed by a glass plate 17, louvres 18 being present on the glass plate.

The reflector means 9 have their greatest spreading effect in planes perpendicular to the insertion direction of the lampholder 7 owing to its strongly bent shape, stepwise in the Figures, in the planes. The reflector 15 on the other hand has its greatest spreading effect exactly in a plane through the insertion direction of the lampholder owing to its shape which is bent in a direction transverse to the above directions, stepwise in the Figures.

The luminaire yields an even illumination of a ground surface with the primary beam and provides a uniform appearance of objects illuminated by the secondary beams, such as, for example, facades or panels mounted thereto.

Figure 3:
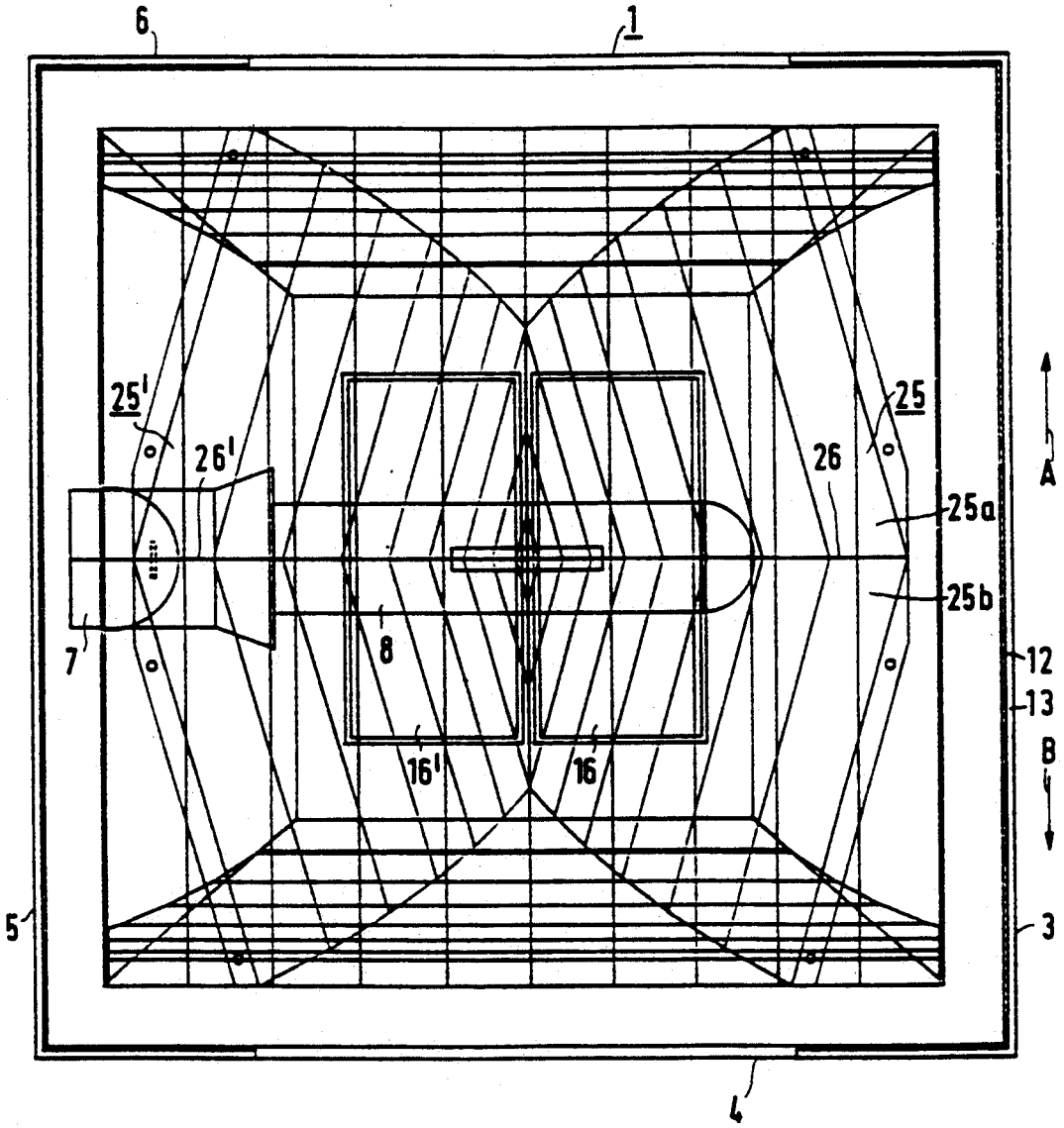
FIG. 3 is a view according to III in FIG. 1 of another embodiment.

In FIG. 3 all parts are shown as if they were transparent. Except for the reflectors 25, 25' all parts have the same reference numeral as corresponding parts in the preceding Figs. The reflectors 25 and 25' are each kinked backwards to have a kink 26 and 26' respectively in a plane through the lampholder 7. The reflecting surfaces **25*a* and 25*b* of reflector 25 are under an angle of more than 180° to each other. Thereby they throw a larger portion of the light reflected into the direction indicated by arrows A and B respectively than without kink 26** being present.

We claim:

1. A luminaire for creating a primary beam of light and a secondary beam of light comprising (a) a housing structure having an emission window for passing a primary beam of light and having a plurality of sidewalls about said emission window, said plurality of sidewalls having at least one window for passing a secondary beam of light;

(b) a lampholder within said housing structure for accommodating an electric lamp adjacent said emission window;

(c) concave reflector means for reflecting light generated by said electric lamp through said emission window as at least part of said primary beam of light, said concave reflector means having an opening remote from said emission window;

(d) secondary reflector means within said housing structure for reflecting light that passes through said opening toward said at least one window in said plurality of sidewalls, said opening being closed by a color filter defining secondary light; and (e) light distributing means adjacent said at least one window for distributing said secondary light through said at least one window.

2. A luminaire according to claim 1, wherein said lampholder is an Edison lampholder.

3. A luminaire according to claim 2, wherein said light distributing means is a profiled glass plate disposed at said at least one window, said profiled glass plate spreading said secondary light substantially parallel to said emission window.

4. A luminaire according to claim 2, wherein said at least one window extends between opposing sidewalls.

5. A luminaire according to claim 2, wherein a second window is disposed in an opposing sidewall to said at least one window.

6. A luminaire according to claim 5, wherein said secondary reflector means also reflects light to said second window.

7. A luminaire according to claim 6, wherein said light distributing means is a profiled glass plate also disposed at said second window.

8. A luminaire according to claim 2, wherein said secondary reflector means includes a reflector being bent substantially parallel to said emission window.

9. A luminaire according to claim 2, wherein said secondary reflector means is provided with a kink to spread reflected light parallel to said emission window.

10. A luminaire according to claim 2, wherein a glass plate and louvres on said glass plate are disposed between said electric lamp and said emission window.

* * * * *